United States Patent [19]

Suska

[11] Patent Number: 4,596,407

[45] Date of Patent: Jun. 24, 1986

[54] PERIODICAL INFORMATION STORAGE AND RETRIEVAL SYSTEM

[76] Inventor: Charles R. Suska, R.R. 1, Box 14, Roxbury, Conn. 06783

[21] Appl. No.: 645,041

[22] Filed: Aug. 28, 1984

[51] Int. Cl.[4] ..... B42D 1/00; B42D 15/00

[52] U.S. Cl. ..... 281/15 R; 281/38; 281/41; 283/38

[58] Field of Search ..... 281/15 R, 38, 41; 283/56, 38–46

[56] References Cited

U.S. PATENT DOCUMENTS

| | | | |
|---|---|---|---|
| 438,744 | 10/1890 | Tifft | 283/56 X |
| 880,513 | 3/1908 | Fox | 283/56 |
| 1,166,900 | 1/1916 | Gould | 283/56 |
| 1,612,240 | 12/1926 | Uptegraff | 283/56 |
| 3,517,947 | 6/1930 | Bennett | 283/56 |
| 4,084,696 | 4/1978 | Katz | 283/56 X |

FOREIGN PATENT DOCUMENTS

| | | | |
|---|---|---|---|
| 374773 | 6/1932 | United Kingdom | 281/15 R |

*Primary Examiner*—Paul A. Bell

*Attorney, Agent, or Firm*—Brumbaugh, Graves, Donohue & Raymond

[57] ABSTRACT

An information storage and retrieval system includes a periodical constructed to facilitate storage and retrieval of information found therein. The periodical includes a plurality of titled articles and the like and two index pages identifying the articles. One of the index pages is adapted to be removed from the periodical for separate storage and use in a suitable filing device to facilitate retrieval of information from a series of the periodicals.

8 Claims, 2 Drawing Figures

PERIODICAL INFORMATION STORAGE AND RETRIEVAL SYSTEM

BACKGROUND OF THE INVENTION

Periodicals print articles and other information with reference value for a variety of purposes. Thus magazines are published in many fields of interest, including business, medicine, engineering, manufacturing, agriculture, education, the arts, geography, travel, and the like. Access to the information thus published is possible through certain indices or storage and retrieval systems based on microfilm, microfiche or computers. Alternatively, a researcher can review the index or table of contents in each issue of each magazine published in a field of interest, a laborious and time-consuming chore.

Printed or other indices for one or more fields of interest often include a great number of periodicals. To compile such indices is time-consuming and expensive, and results in their limited ditribution and hence restricted access by researchers.

On the other hand, a researcher desiring information on a particular subject, without access to such expensive indices, is forced to the time-consuming chore of reviewing the table of contents of each issue of a series of magazines of interest, an unsatisfactory research procedure.

SUMMARY OF THE INVENTION

The present invention is directed to an improved periodical constructed to facilitate storage and retrieval of information found in the periodical.

More particularly, an improved storage and retrieval system includes a periodical having two index pages identifying articles and other information found in the periodical. One of the index pages in each of a series of periodicals is adapted to be removed and placed in a suitable binder. With this system, a researcher may review the binder contents to identify quickly any article or other information of interest in a year or several years' issues of a particular magazine.

The use of this system obviates the optical, electrical or other equipment often required for retrieval of information found on microfilm and the like. However, the system is compatible with and can supplement the more expensive systems involving microfilm, microfiche and computers.

DESCRIPTION OF EXEMPLARY EMBODIMENTS

Figure 1:
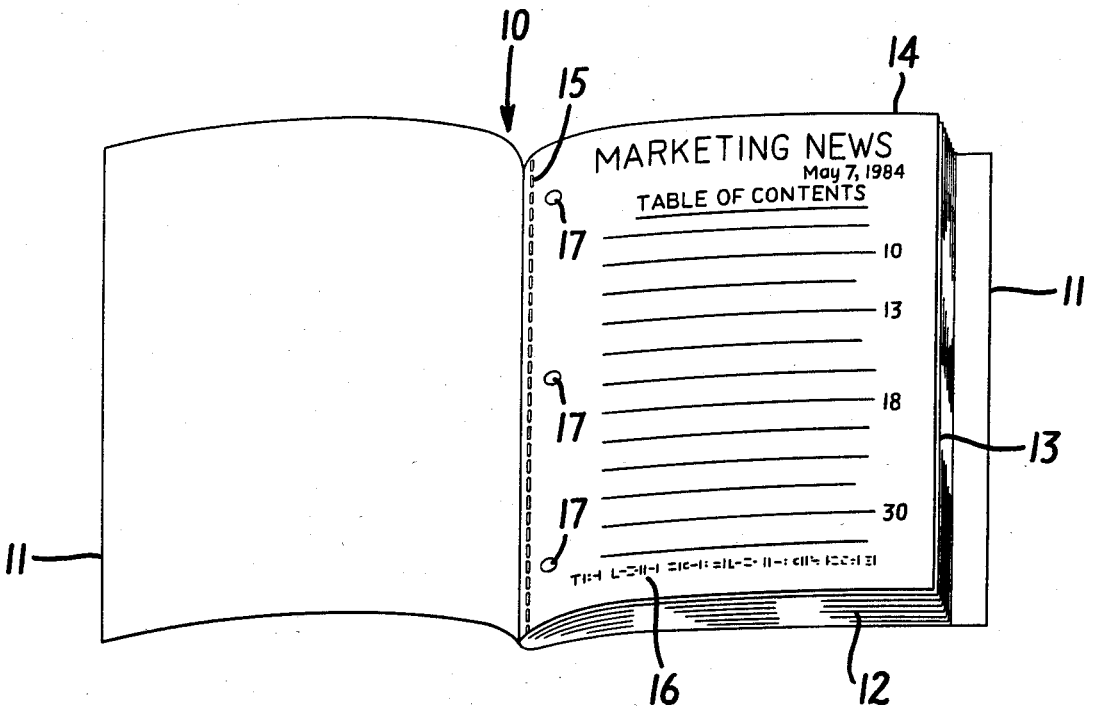
FIG. 1 is a view in perspective of a periodical constructed in accordance with the present invention.

Referring to the invention in greater detail with reference to FIG. 1, a periodical 10 in the form of a magazine includes a cover 11 and pages 12 containing a plurality of titled articles and other information. A normal index or table of contents page 13, identifying the articles and information, is located in the conventional manner near the front of the magazine. Juxtaposed with page 13 is another index page 14 which also identifies the articles and information found on page 13. In some instances, page 14 may be substantially identical to the page 13.

However, in other instances the index page 14 may include a brief abstract or description of the information found in each article or other item listed.

In contrast to page 13, page 14 is adapted to be removed from the periodical by providing, for example, along its inner edge a line 15, which may be weakened by perforations or the like. Note, however, that the page 14 may be bound into the magazine in such a manner that it is readily removable without the need of a weakened line such as is provided by the perforations 15, or by any other manner of weakening the binding of the page.

Page 14 may be located in any relation to the page 13 facilitating its identification and removal. Preferably the additional index removal page 14 includes a legend 16 at its lower edge, as shown, or in any other desirable position, stating "This page may be removed and placed in a binder for reference purposes."

If desired, suitably positioned holes 17 enable insertion of the page into a three ring binder.

Figure 2:
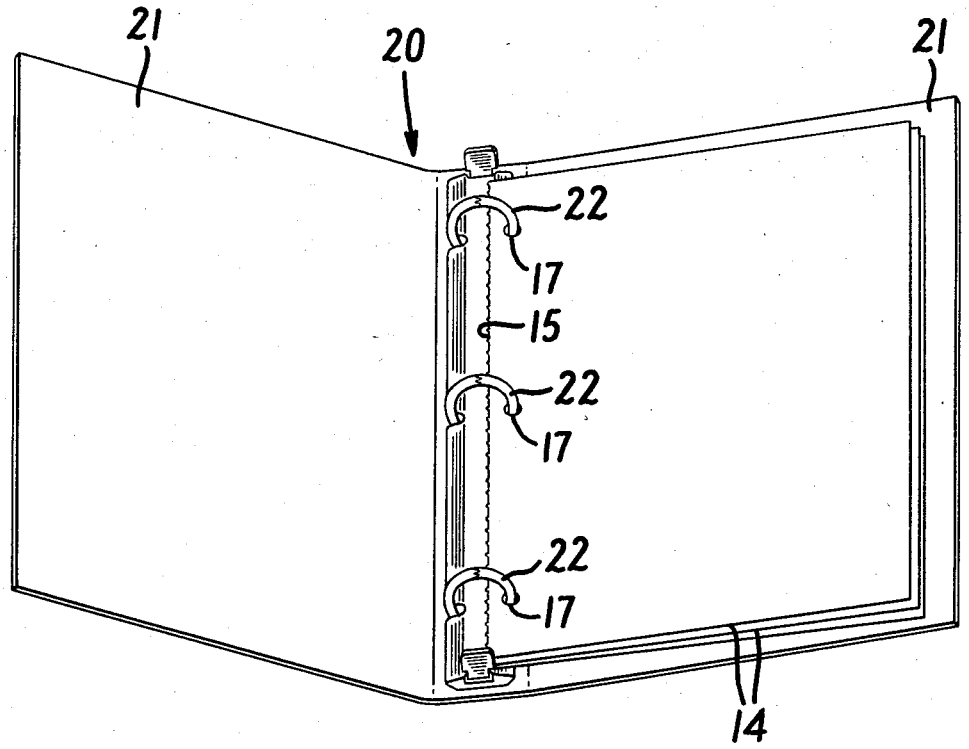
FIG. 2 is a filing device forming part of the information storage and retrieval system adapted to receive pages from a series of periodicals such as the one shown in FIG. 1.

Referring to FIG. 2, a filing device for the index pages 14 from a series of the periodicals 10 is shown as a three ring binder 20 including a cover 21 and three snap-opening rings 22. Other suitable filing devices such as folders, clip boards and various fasterns can also be used to hold the pages 14.

In using the inventive storage and retrieval system, the binder 20 is located at a convenient point such as in a library accessible to the public. A researcher may then review the index pages 14 in the binder 20, locate an article or articles, or other information of interest, and then request the librarian to retrieve from the stacks the periodical 10 in which the article of interest may be found.

To enhance the usefulness of the invention periodical, the reverse side of the removable index page 14 may be used for advertisements by organizations interested in the longer term retention and improved visibility of their messages. With this arrangement, the periodical's schedule of advertising would benefit since a premium could be charged for space on the second index sheet in view of its longer lasting and frequently reviewed nature.

While the invention has been described with reference to a specific embodiment, it will be understood that various changes and modifications may be made within the scope of the invention which is defined in the appended claims.

I claim:

1. A periodical constructed to facilitate storage and retrieval of information found in the periodical comprising a plurality of pages carrying a number of titled articles and the like, two pages in the periodical identifying at least said articles, one of said pages being adapted to be removed from the periodical for separate storage and use to facilitate retrieval of information from the periodical.

2. A periodical as defined in claim 1, wherein removal page is weakened along a line to facilitate its removal from the periodical without damage thereto.

3. A periodical as defined in claim 1, wherein the removal page is provided with holes to facilitate its separate storage and use.

4. A periodical as defined in claim 1, in which a legend is provided on the removal page for indicating its purpose.

5. An information storage and retrieval system comprising a periodical including a plurality of titled articles and the like, two pages in the periodical identifying at least said articles, one of said pages being adapted to be removed from the periodical, a suitable filing device for receiving the removal pages from a series of the periodicals, whereby review of the filing device contents enables identification of the periodical containing an article or information of interest.

6. An information storage and retrieval system as defined in claim 5, wherein the removal page is weakened along a line to facilitate its removal from the periodical without damage thereto.

7. An information storage and retrieval system as defined in claim 5, wherein the removal page is provided with holes spaced to cooperate with retaining elements in the filing device.

8. An information storage and retrieval system as defined in claim 5, in which a legend is provided on the removal page for indicating its purpose.

* * * * *